US010420443B2

(12) United States Patent
St. John

(10) Patent No.: US 10,420,443 B2
(45) Date of Patent: Sep. 24, 2019

(54) MULTIPURPOSE GARMENT

(71) Applicant: Journey St. John, Warrenville Heights, OH (US)

(72) Inventor: Journey St. John, Warrenville Heights, OH (US)

(73) Assignee: Journey St. John, Warrensville Hts, OH (US)

( * ) Notice: Subject to any disclaimer, the term of this patent is extended or adjusted under 35 U.S.C. 154(b) by 111 days.

(21) Appl. No.: 14/995,533

(22) Filed: Jan. 14, 2016

(65) Prior Publication Data

US 2017/0202275 A1 Jul. 20, 2017

(51) Int. Cl.

| | |
|---|---|
| ***A47K 10/02*** | (2006.01) |
| ***A41D 27/10*** | (2006.01) |
| ***A41D 13/00*** | (2006.01) |
| *A41D 15/00* | (2006.01) |

(52) U.S. Cl.

CPC ..... *A47K 10/02* (2013.01); *A41D 13/0012* (2013.01); *A41D 27/10* (2013.01); *A41D 15/002* (2013.01)

(58) Field of Classification Search

CPC ..... A41D 15/002; A41D 27/10; A41D 27/20; A41F 9/007

See application file for complete search history.

(56) References Cited

U.S. PATENT DOCUMENTS

| | | | | | |
|---|---|---|---|---|---|
| 3,529,307 | A * | 9/1970 | Belson | A41D 13/0012 | 2/94 |
| 4,106,121 | A * | 8/1978 | Belson | A41D 13/0012 | 2/102 |
| 4,637,075 | A * | 1/1987 | Ingrisano | A41D 13/0012 | 2/102 |
| 4,944,042 | A * | 7/1990 | DeWan | A41D 15/04 | 190/1 |
| 5,247,707 | A * | 9/1993 | Parker | A41D 13/0012 | 2/102 |
| 5,526,535 | A * | 6/1996 | Dobrzenski | A41D 13/0012 | 2/102 |
| 5,603,646 | A * | 2/1997 | Tobias | A41D 13/0125 | 441/106 |
| 5,617,582 | A * | 4/1997 | Burwell | A41D 13/0012 | 2/102 |
| 5,644,794 | A * | 7/1997 | Hull | A41D 13/0012 | 2/102 |
| 5,718,000 | A * | 2/1998 | Ost | A41D 3/00 | 2/102 |

(Continued)

*Primary Examiner* — Anne M Kozak

(57) ABSTRACT

A multipurpose garment is a vest with a detachable first sleeve and a detachable second sleeve. Sleeve fasteners positioned along a first arm cuff, second arm cuff, first detachable sleeve, and second detachable sleeve allow for the sleeves to be attached and detached from the vest. For storage purposes, a plurality of pockets is positioned across a rear panel and a front panel of the vest. Additionally, an elastomeric retention strap is positioned on the front flap and can be used to hold items against the vest. The plurality of pockets includes two columns of pockets plus a lone pocket on the front. The plurality of pockets also includes a first and second rear pocket which are connected by a channel, suited for electronic devices and portable power supplies. Drawstrings and belt loops, and front panel flaps allow for the garment to adjust to a better fit for a person.

7 Claims, 6 Drawing Sheets

(56) References Cited

U.S. PATENT DOCUMENTS

| | | | | | |
|---|---|---|---|---|---|
| 6,029,270 | A * | 2/2000 | Ost | A41D 3/00 | 2/2.5 |
| 6,047,404 | A * | 4/2000 | Blanks I | A41D 15/00 | 2/108 |
| 7,392,549 | B1 * | 7/2008 | Barber | A41D 13/0012 | 2/269 |
| 7,712,148 | B2 * | 5/2010 | Carlson | F41H 1/02 | 2/102 |
| D641,960 | S * | 7/2011 | Goff | D2/829 | |
| 8,875,314 | B1 * | 11/2014 | Panetta | A41D 13/0012 | 2/102 |
| D734,963 | S * | 7/2015 | Deng | D6/611 | |
| 2003/0188371 | A1 * | 10/2003 | Duhammel | A41D 13/018 | 2/102 |
| 2012/0174296 | A1 * | 7/2012 | Martin | A62B 17/006 | 2/457 |

* cited by examiner

MULTIPURPOSE GARMENT

FIELD OF THE INVENTION

The present invention relates generally to an adaptable garment with improved storage capabilities.

BACKGROUND OF THE INVENTION

A variety of garments have been produced for purpose specific applications. For example, clothing has been constructed to meet the needs of those in sports, health care, law enforcement, and numerous other industries. Clothing has also been provided specifically for hobbyists, such as bicycle riders, hikers, and others. While some apparel attempts to serve the needs of multiple occupations and activities, such garments often fall short of their goals or are otherwise lacking.

The present invention provides an upper body garment which is convenient and adaptable to a number of activities. The present invention is a vest with removable sleeves and a versatility of storage options. Storage is provided by a number of pockets on both the front and the back of the vest. Additional storage is provided through retention straps and an accessory mount.

The present invention is thus able to hold a wide variety of items for different purposes. For example, towels, water bottles, flash lights, keys, tissues, pepper spray, EpiPens (for injecting epinephrine), business cards, and personal electronics can all be stored via the present invention.

DETAIL DESCRIPTIONS OF THE INVENTION

Figure 1:
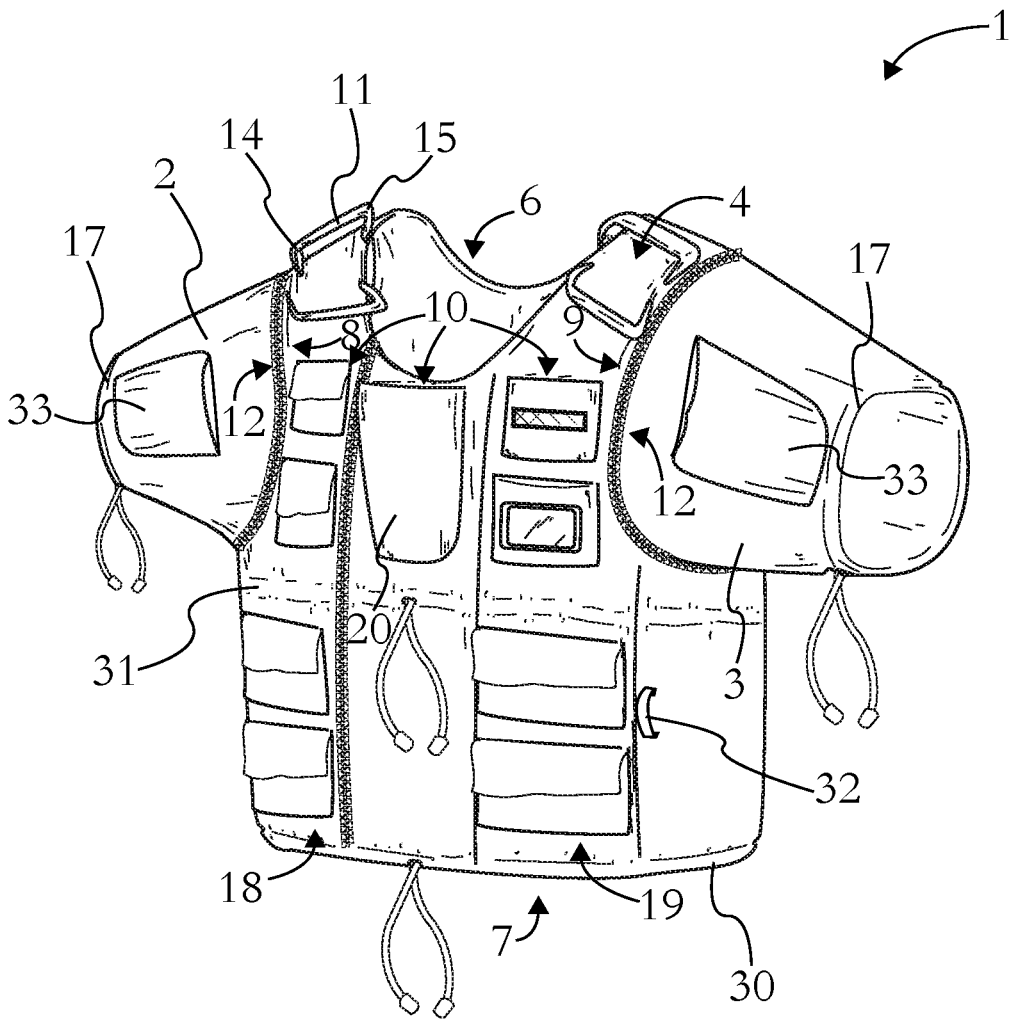
FIG. 1 is a front perspective view of the present invention.

All illustrations of the drawings are for the purpose of describing selected versions of the present invention and are not intended to limit the scope of the present invention.

The present invention is a garment for the upper body which provides several benefits for exercise and general everyday use as compared to existing garments. Supporting this, the present invention comprises a vest 1, a first sleeve 2, and a second sleeve 3. The first sleeve 2 and the second sleeve 3 are each adjacently attached to the vest 1, with the first sleeve 2 being provided for a person's right arm and the second sleeve 3 being provided for a person's left arm. Resultantly, the vest 1 is positioned between the two sleeves. As the sleeves are not permanently connected to the vest 1, they may be detached and attached to the vest 1 according to the convenience of user. For example, in cooler weather it may be desirable for a user to leave both sleeves attached to the vest 1. Alternatively, in warmer weather it may be desirable to detach the sleeves from the vest 1. As an additional benefit, the detached sleeves can be used as item holders, as later explained in greater detail. An embodiment of the present invention is shown in FIG. 1-FIG. 6.

The vest 1 itself comprises a front panel 4, a rear panel 5, a collar 6, a waist 7, a first arm cuff 8, a second arm cuff 9, a plurality of pockets 10, and an at least one elastomeric retention strap 11. The front panel 4 and the rear panel 5 form the front and back of the vest 1. The collar 6 is at the top of the vest 1 and provides room for a person's head, while the waist 7 is at the bottom of the vest 1, creating room for a user's abdomen. The first arm cuff 8 and the second arm cuff 9 are openings which receive a user's arms. Furthermore, the first arm cuff 8 and the second arm cuff 9 serve as attachment points for the first sleeve 2 and the second sleeve 3, enabled by corresponding fasteners as detailed later.

Further defining the first sleeve 2 and the second sleeve 3, each comprises a proximal sleeve cuff 12 and a distal sleeve cuff 13. The proximal sleeve cuff 12 is the portion of the sleeve that is joined to the corresponding cuff of the vest 1, while the distal sleeve cuff 13 remains open as an outlet for a user's arms. Resultantly, the proximal sleeve cuff 12 is positioned adjacent to the vest 1, while the distal sleeve is positioned opposite the vest 1 along the respective sleeve.

The plurality of pockets 10, which allow for storage of a large variety of items, is formed on both the front panel 4 and the rear panel 5 of the vest 1. As the plurality of pockets 10 is formed on the body of the vest 1, the pockets 10 are positioned between the collar 6 and the waist 7, rather than extending past the area of the vest 1. The elastomeric retention strap 11 allows for additional storage, as items can be held between the vest 1 body and the elastomeric retention strap 11 by tension. The elastomeric retention strap 11 comprises a first end 14 and a second end 15 each of which are adjacently connected to the front panel 4. An item-receiving volume is thus created between the elastomeric retention strap 11 and the vest 1, which can be used to secure items to the vest 1. Preferably, as shown in the illustrated embodiment, there are two elastomeric retention straps 11 on either side of the front panel 4. These elastomeric retention straps 11 allow, for example, a towel to be secured around a user's neck. By threading the towel between the first end 14 and second end 15 of each elastomeric retention strap 11, the towel is allowed to hang down the front of a user's torso while remaining secured. The towel is thus readily available for wiping away sweat or mud.

To allow for the first sleeve 2 and the second sleeve 3 to be attached to or detached from the vest 1, the first sleeve 2 cuff, the second sleeve 3 cuff, and the proximal sleeve cuff 12 (of each sleeve) all comprise a sleeve fastener 16. The sleeve fastener 16 of the first sleeve 2 cuff is thus engaged with the sleeve fastener 16 of the first sleeve's 2 proximal sleeve cuff 12. Likewise, the sleeve fastener 16 of the second sleeve 3 cuff is engaged with the sleeve fastener 16 of the second sleeve's 3 proximal sleeve cuff 12.

The sleeve fasteners 16 themselves are connected around the aforementioned cuffs, in a manner that allows them to engage with each other. Therefore, there is a sleeve fastener 16 connected around the first sleeve 2 cuff, a sleeve fastener 16 connected around the second sleeve 3 cuff, and a sleeve fastener 16 connected around each of the proximal sleeve cuffs 12.

In the preferred and illustrated embodiment, the sleeve fasteners 16 are of a zipper style. In such an embodiment, each fastener is actually a line of teeth connected along the edge of the respective cuff, which can be engaged or disengaged with each other by moving a zipper along the lines of teeth. This does not preclude the use of other types of fasteners in alternative embodiments. For example, hook-and-loop fasteners (commonly referred to by the trademarked name of Velcro) or snap fasteners could be used in place of the preferred embodiment's zipper as sleeve fasteners 16. These are just a few examples of potential alternative implementations for the sleeve fasteners 16, and do not restrict the use of further alternatives.

Another property of the preferred embodiment is the inclusion of a drawstring 17 for each sleeve. More specifically, the first sleeve 2 and the second sleeve 3 each comprise a drawstring 17. The drawstring 17 is perimetrically aligned with the distal sleeve cuff 13, and is further housed within the distal sleeve cuff 13. The drawstring 17 is normally left loose, such that the distal sleeve cuff 13 remains open for a user's arm. However, the drawstring 17 can be tightened, effectively closing the distal sleeve cuff 13, as the user desires. A few potential scenarios in which the drawstring 17 might be closed follow. One such example is in cold weather in which a user would like to better insulate themselves; the drawstrings 17 can be closed to minimize the exchange of cold ambient air with warmer air interior to the vest 1.

In another configuration, when the first sleeve 2 and second sleeve 3 are detached from the vest 1, and in which the first sleeve 2 and the second sleeve 3 each comprise a sleeve pocket 33, the two sleeves can be worn on the legs of a person. For example, the sleeves could be attached to a person's leg by tightening the drawstrings 17 about a person's legs. In another example, provided the person's pant have fasteners that are compatible with the sleeve fasteners 16, the sleeves could be joined with pants or a similar garment by means of the sleeve fasteners 16. The sleeve pocket 33 of the first sleeve 2 and the second sleeve 3 allows for accessories (e.g. water bottles/containers) to be mounted to the sleeves. The sleeves are capable of supporting such accessories in any configuration, such as secured to the vest 1 or secured about a person's legs. By tightening the drawstrings 17 and thus closing the distal sleeve cuffs 13, a pair of portable containers is formed thanks to the sleeve pockets 33 of the two sleeves. The converted sleeves can then be used to hold bottles (e.g. water bottles) or ultimately any item capable of fitting within the formed container.

Continuing the theme of storage capabilities, the present invention may comprise further straps beyond the initial elastomeric retention strap 11, as shown in the illustrated embodiment. For example, an additional elastomeric retention strap 11 may be connected to the front panel 4, positioned opposite the first elastomeric retention strap 11. Two additional elastomeric retention straps 11 can also be placed below the upper elastomeric retention straps 11. This configuration is illustrated in FIG. 1 and FIG. 3-FIG. 5, which shows four elastomeric retention straps 11, two each at a front shoulder portion of the vest 1. Further elastomeric retention straps 11 could be adjacently connected to the vest 1 at various positions in alternative, non-illustrated embodiments of the present invention.

The plurality of pockets 10, as mentioned, is distributed across the front panel 4 and the rear panel 5 of the vest 1. For the front panel 4, the plurality of pockets 10 comprises a first column of pockets 18, a second column of pockets 19, and a central pocket 20. The first column of pockets 18 is connected along the front panel 4 from the waist 7 to the collar 6. Likewise, the second column of pockets 19 is connected along the front panel 4 from the waist 7 to the collar 6. This results in two linear groups of pockets, one being provided for each side of the vest 1. The central pocket 20 is adjacently connected to the front panel 4 and is centrally positioned on the front panel 4, such that it is equally accessible to a user's left arm and a user's right arm.

The first column of pockets 18 and the second column of pockets 19, being provided for either side of the front panel 4, are positioned on a left portion and a right portion of the front panel 4. More specifically, the first column of pockets 18 is positioned adjacent to the first arm cuff 8 while the second column of pockets 19 is positioned adjacent to the second arm cuff 9. The two columns of pockets are separated by the central pocket 20, with the central pocket 20 being positioned between the first column of pockets 18 and the second column of pockets 19.

While the illustrated embodiment shows the four pockets each for the first column of pockets 18 and the second column of pockets 19, the exact number of pockets can be altered in variant embodiments of the present invention. Furthermore, the shape and size (and therefore capacity) of the pockets can also be altered. Though the illustrated embodiment shows oblong pockets, ovoid, triangular, and other shapes of pockets may be implemented alongside or in place of the oblong pockets of the illustrated embodiment.

Potentially, an accessory mount 21 can be adjacently connected to vest 1, adjacent to one of the plurality of pockets 10. For example, the illustrated embodiment shows a ring as the accessory mount 21, with the ring being positioned adjacent to the first column of pockets 18. The ring allows a number of accessory items, e.g. keys, to be secured to the vest 1. This is another way that the present invention improves storage capabilities.

Beyond the front panel 4, the plurality of pockets 10 is expanded to encompass the rear panel 5, as originally mentioned. For the rear panel 5, the plurality of pockets 10 comprises a first rear pocket 22 and a second rear pocket 23. The first rear pocket 22 is preferably positioned across the rear panel 5 and from the collar 6 to the waist 7 opening. The second rear pocket 23 is positioned adjacent to the waist 7, between the waist 7 and the first rear pocket 22. The first rear pocket 22, resultantly, covers a large portion of the rear panel 5. This provides a large interior volume for the first rear pocket 22, allowing it to hold large items such as computer laptops and similar electronic devices. The second rear pocket 23 is positioned across the rear panel 5, aligned with the waist 7. The resulting elongated shape is suitable for holding batteries and other portable power sources which can be used to charge electronic devices carried by the vest 1.

Figure 2:
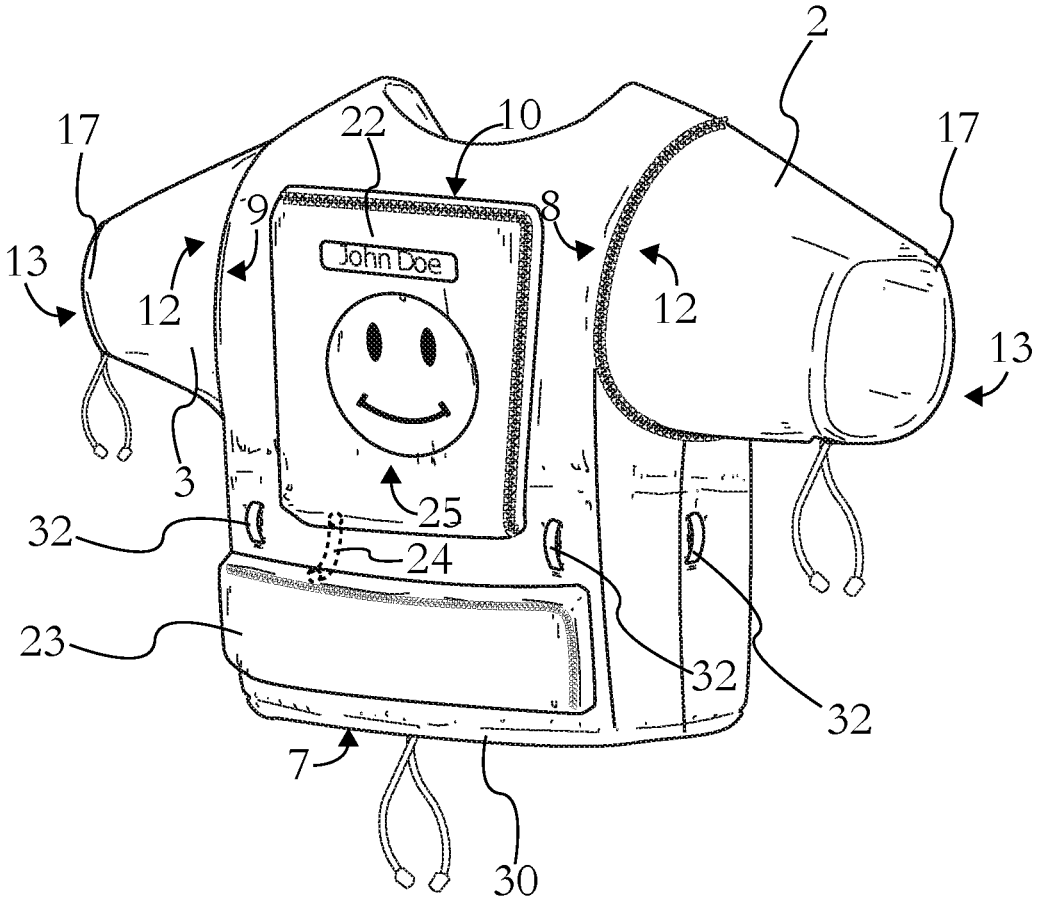
FIG. 2 is a rear perspective view of the present invention.
Figure 3:
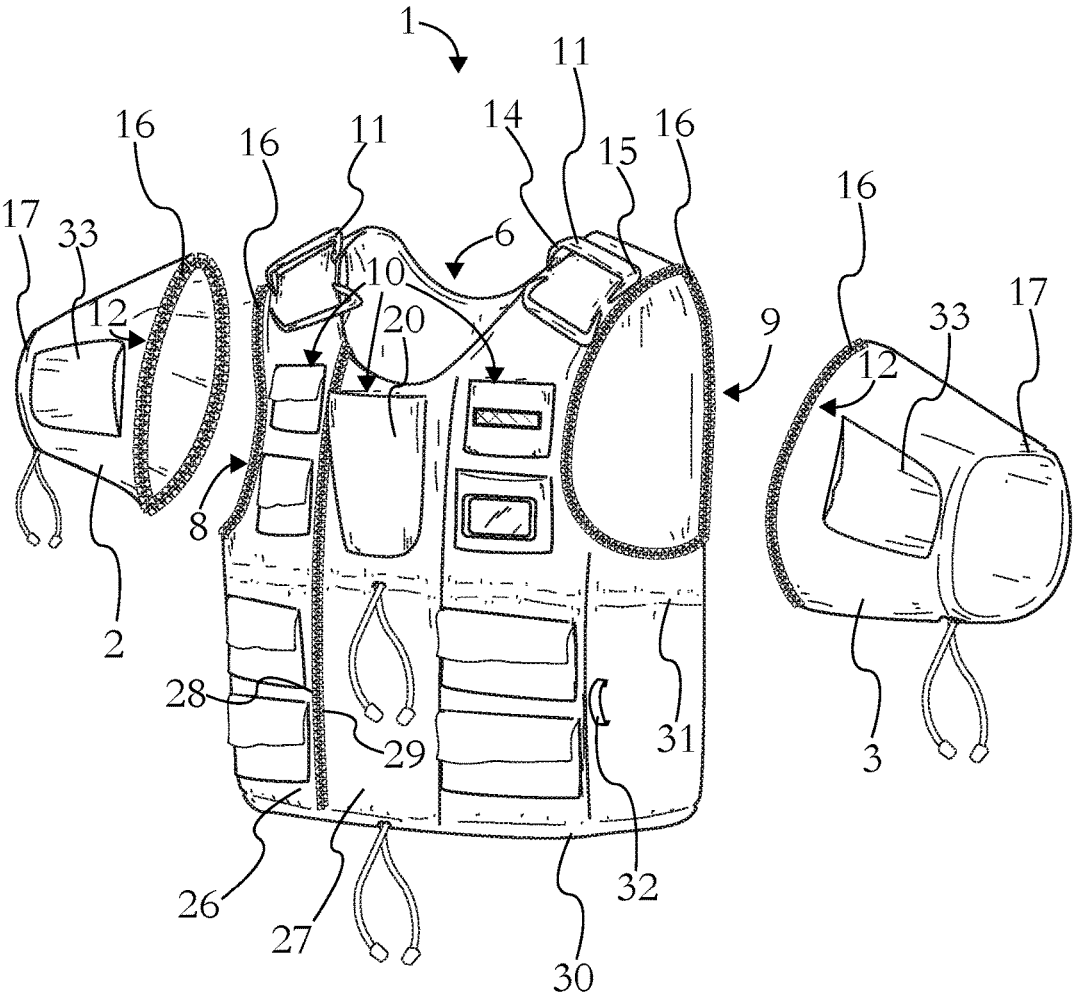
FIG. 3 is a front perspective view showing a first sleeve and a second sleeve detached from a vest of the present invention.
Figure 4:
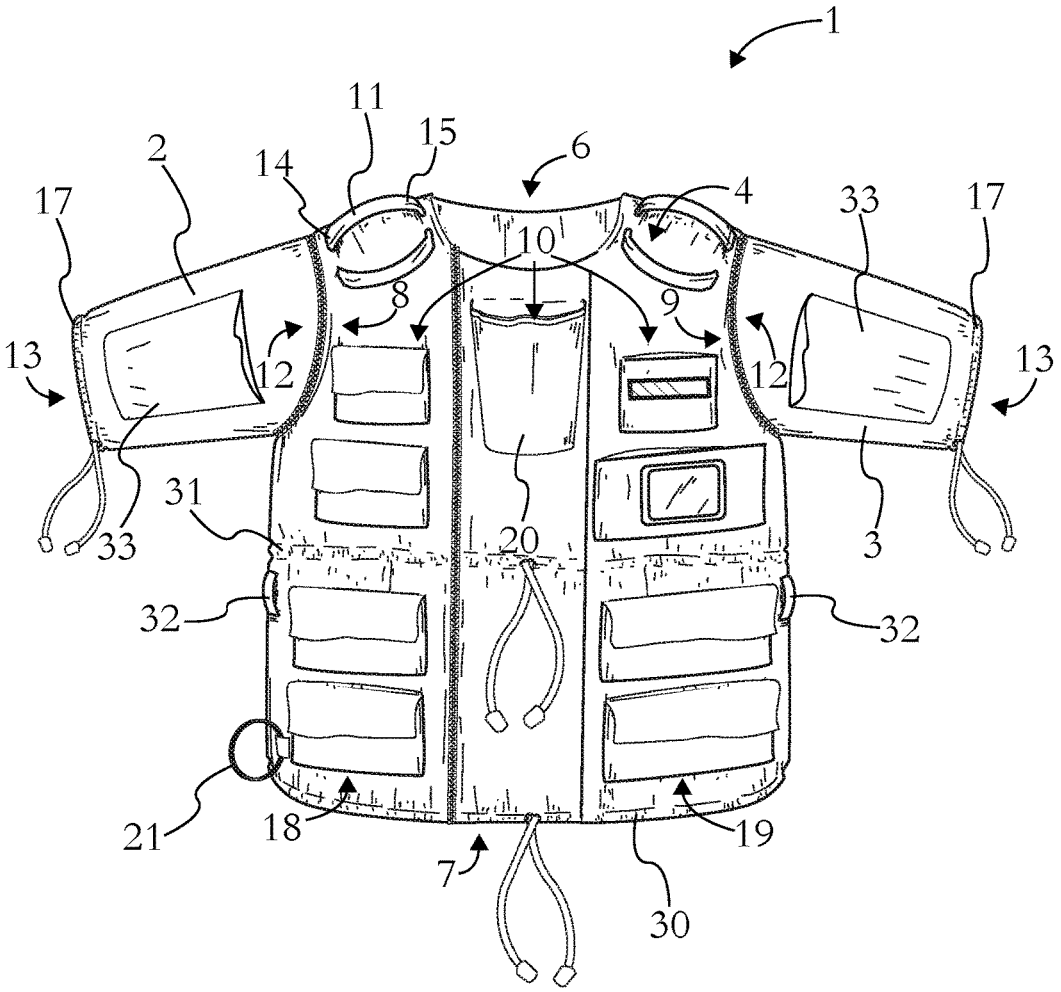
FIG. 4 is a front elevational view of the present invention.
Figure 5:
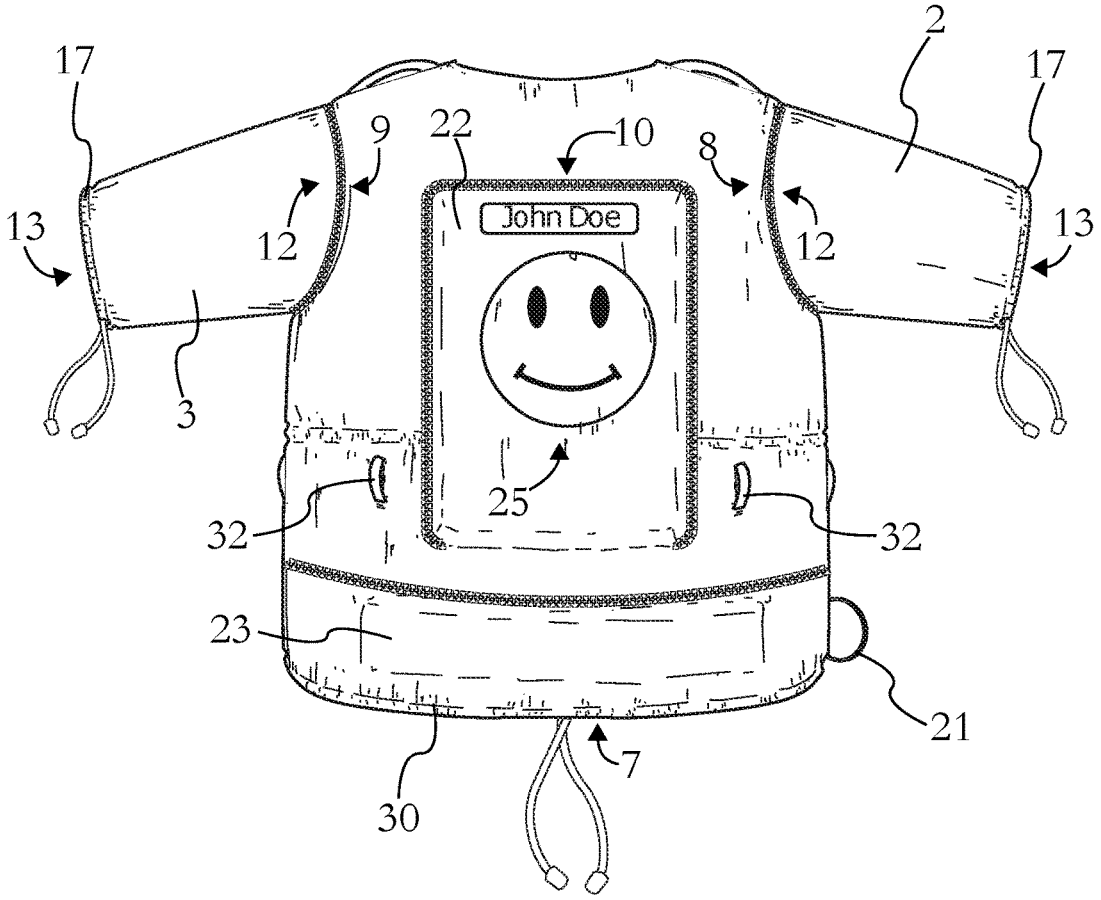
FIG. 5 is a rear elevational view of the present invention.
Figure 6:
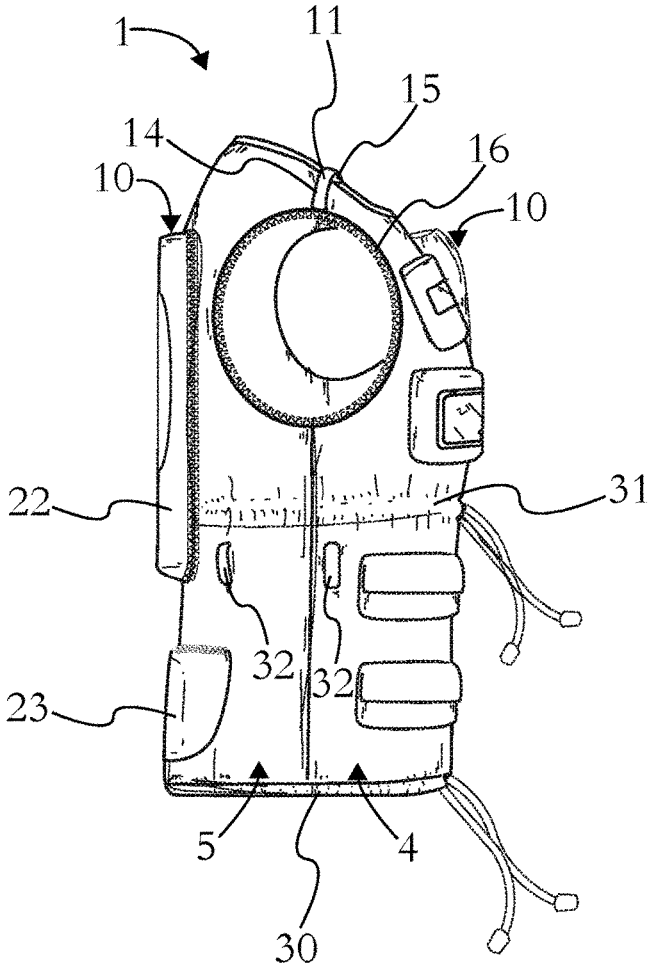
FIG. 6 is a left-side elevational view of the present invention.

Preferably, to allow for wired components (e.g. the aforementioned computer laptop and battery), a channel 24 is housed in the rear panel 5. The channel 24 is connected between the first rear pocket 22 and the second rear pocket 23, forming an enclosed sleeve within the rear panel 5. Wires and similar items can be routed through this channel 24 in order to connect the content of the first rear pocket 22 with the contents of the second rear pocket 23. While the provided example suggests interconnecting electronic devices, ultimately any two or more items may be connected to each other through the channel 24. A potential positioning of the channel 24 is shown in FIG. 2.

The first rear pocket 22, on an exterior surface, can comprise a marking 25, with the marking 25 being imprinted onto the first rear pocket 22. The marking 25 can be a graphic image, text, or a combination of the two. For example, in the illustrated embodiment the marking 25 includes a name and a picture. The marking 25 is not limited to such examples; any sort of visual stimulus can be included as part of the marking 25.

The vest 1 of the present invention can be improved upon, as shown in the illustrated embodiments and subsequently described. One such improvement is splitting the front panel 4 into a first flap 26 and a second flap 27. Doing so makes the present invention easier to don and remove. Connected along the first flap 26 is a first panel fastener 28. Correspondingly, a second panel fastener 29 is connected along the second flap 27. The first panel fastener 28 and the second panel fastener 29 are engaged with each other in order to attach the first flap 26 to the second flap 27 at an offset position with respect to the front panel, as shown in FIG. 1. As with the sleeve fasteners 16, these fasteners can be of various types. While the illustrated embodiment shows them as a zipper fastener, in other embodiments snap fasteners or hook-and-loop fasteners can be used instead. All of these serve the same purpose, in that by engaging or disengaging them, the first flap 26 and the second flap 27 can be detached and opened or attached and closed.

Potentially, the vest 1 may also comprise a lower drawstring 30, an upper drawstring 31, and a belt loop 32. The lower drawstring 30 and the upper drawstring 31 are each integrated into the vest 1, being positioned across the front panel 4 and the rear panel 5, in an elliptical shape. Each of the lower drawstring and the upper drawstring has a portion through which ends of each respective drawstring extend, each portion being located below the central pocket, as shown in FIG. 1. The upper drawstring 31, being positioned between the collar 6 and the waist 7, is housed within the front panel 4 and the rear panel 5. The lower drawstring 30, positioned at the bottom of the vest 1, is housed within the waist 7. Both the upper drawstring 31 and the lower drawstring 30 can be tightened or loosened in order to adjust the fit of the vest 1.

The belt loop 32 are provided to allow a belt to be secured about the vest 1. A secured belt can then tightened or loosened in order to adjust the fit of the vest 1 about a user. The belt loops are connected across both the front panel 4 and the rear panel 5, best illustrated through FIG. 6. The belt loops are positioned around the vest 1 in an elliptical shape, similar to the lower drawstring 30 and the upper drawstring 31, to create an optimal and ergonomic receptacle for a belt.

The present invention, as thus far described, is capable of storing or otherwise carrying a variety of items. In a preferred embodiment, the plurality of pockets 10 and the at least one retention strap are optimally configured to allow a water bottle, towel, tissues, keys, flashlights, laptops, batteries, business cards, and writing utensils to be carried on one's person. A user is thus able to access a number of items in preparation for a variety of scenarios. As a demonstration of the versatility of the present invention, towels, water bottles, a phone, and fitness related devices can be stored in the vest 1 in preparation for a run. Alternatively, for extended excursions, such as day out in a city while on vacation, snacks, drinks, money, phrase books, cameras, electronics, and similar items can be stored in the vest 1.

Other examples of items that can be stored include medical items (e.g. EpiPens for allergic reactions), food and beverages, photography equipment, business items, survival gear, and more. This versatility enables the present invention to be used for a variety of applications.

Although the invention has been explained in relation to its preferred embodiment, it is to be understood that many other possible modifications and variations can be made without departing from the spirit and scope of the invention as hereinafter claimed.

What is claimed is:

1. A multipurpose garment comprising: a vest; a first short sleeve configured to extend to a user's first arm; a second short sleeve configured to extend to a user's second arm; the first short sleeve being configured to be removably attached to the vest; the second short sleeve being configured to be removably attached to the vest; the vest being positioned in between the first short sleeve and the second short sleeve; the vest comprising a front panel, a rear panel, a collar, a waist, a first arm cuff, a second arm cuff, a plurality of pockets, a first upper elastomeric retention strap and a second upper elastomeric retention strap, a first additional elastomeric retention strap positioned below the first upper elastomeric retention strap and a second additional elastomeric retention strap positioned below the second upper elastomeric retention strap; the first short sleeve comprising a first proximal sleeve cuff and a first distal sleeve cuff; the second short sleeve comprising a second proximal sleeve cuff and a second distal sleeve cuff; the first proximal sleeve cuff being positioned adjacent to the first arm cuff; the second proximal sleeve cuff being positioned adjacent to the second arm cuff; the plurality of pockets being positioned along the front panel and the rear panel; the plurality of pockets being positioned in between the collar and the waist; the front panel comprising a first front shoulder portion and a second front shoulder portion; the first front shoulder portion being positioned adjacent to and in-between the collar and the first arm cuff; the second front shoulder portion being positioned adjacent to and in-between the collar and the second arm cuff; the first upper elastomeric retention strap being connected to the first front shoulder portion; the second elastomeric retention strap being connected to the second front shoulder portion; the first elastomeric retention strap comprising a first collar end and a first arm cuff end extending between a first collar portion of the collar and the first arm cuff; the second elastomeric retention strap comprising a second collar end and a second arm cuff end extending between a second collar portion of the collar and the second arm cuff; the first additional elastomeric retention strap being connected to the first front shoulder portion; the second additional elastomeric retention strap being connected to the second front shoulder portion; the first additional elastomeric retention strap comprising a first additional collar end and a first additional arm cuff end extending between the first collar portion of the collar and the first arm cuff; the second additional elastomeric retention strap comprising a second additional collar end and a second additional arm cuff end extending between the second collar portion of the collar and the second arm cuff; the first collar end and the second collar end each being positioned adjacent to the collar; the first short sleeve comprising a first sleeve drawstring to tighten about the user's arm; the first sleeve drawstring being perimetrically aligned with the first distal sleeve cuff; the first sleeve drawstring being integrated into the first distal sleeve cuff; the second short sleeve comprising a second sleeve drawstring to tighten about the user's arm; the second sleeve drawstring being perimetrically aligned with the second distal sleeve cuff; the second sleeve drawstring being integrated into the second distal sleeve cuff; the plurality of pockets comprising a first column of pockets, a second column of pockets, a central pocket, a first rear pocket, and a second rear pocket; the first column of pockets being located along the front panel on a first flap extending from one portion of the waist to the first collar portion; the second column of pockets being located along the front panel on a second flap extending from another portion of the waist to the second collar portion; the central pocket being located along the front panel on the second flap; the first column of pockets being positioned adjacent to the first arm cuff; the second column of pockets being positioned adjacent to the second arm cuff; the central pocket being positioned in-between the first column of pockets and the second column of pockets; the first flap comprising a first panel fastener; the second flap comprising a second panel fastener; wherein the first panel fastener and the second panel fastener form a zipper fastener; the zipper fastener being capable of releasably engaging the first flap and the second flap, the zipper fastener being positioned such that it is offset on the front panel and extends between the first collar portion and the waist; the first rear pocket being connected to the rear panel; the second rear pocket being connected to the rear panel; the first rear pocket being centrally positioned on the rear panel; the second rear pocket being positioned adjacent to the waist; the vest further comprising a channel; the channel being housed in the rear panel; the channel connecting the first rear pocket and the second rear pocket to form an enclosed sleeve between the first rear pocket and the second rear pocket; the vest further comprising an upper drawstring; the upper drawstring being perimetrically aligned with an upper portion of the waist; the upper drawstring being housed in the front panel and the rear panel; the upper drawstring extending across the front panel and rear panel and having an upper drawstring portion through which ends of the upper drawstring extend, the upper drawstring portion being located below the central pocket; and the vest further comprising an lower drawstring; the lower drawstring being perimetrically aligned with a lower portion of the waist; the lower drawstring being housed in the lower portion of the waist; and the lower drawstring having a lower drawstring portion through which ends of the lower drawstring extend, the lower drawstring portion being located below the central pocket.

2. The multipurpose garment as claimed in claim 1 comprising: the vest comprising a first arm fastener and a second arm fastener; the first arm fastener being connected around the first arm cuff; the second arm fastener being connected around the second arm cuff; the first short sleeve comprising a first proximal sleeve fastener; the first proximal sleeve fastener being connected around the first proximal sleeve cuff; the second short sleeve comprising a second proximal sleeve fastener; the second proximal sleeve fastener being connected around the second proximal sleeve cuff; the first arm fastener being removably engaged with the first proximal sleeve fastener to form a first sleeve zipper; and the second arm fastener being removably engaged with the second proximal sleeve fastener to form a second sleeve zipper.

3. The multipurpose garment as claimed in claim 1 comprising: the first short sleeve comprising a first sleeve pocket; the first sleeve pocket being positioned in-between the first proximal sleeve cuff and the first distal sleeve cuff; the second short sleeve comprising a second sleeve pocket; and the second sleeve pocket being positioned in between the second proximal sleeve cuff and the second distal sleeve cuff.

4. The multipurpose garment as claimed in claim 1 comprising: an accessory mount comprising a ring; the accessory mount being connected to the vest; and the accessory mount being positioned adjacent to one of the plurality of pockets.

5. The multipurpose garment as claimed in claim 1 comprising: a graphic image; and the graphic image being imprinted onto the first rear pocket.

6. The multipurpose garment as claimed in claim 1 comprising: the vest comprising a plurality of belt loops; the plurality of belt loops being located across the front panel and the rear panel; and the plurality of belt loops being positioned around the vest.

7. The multipurpose garment as claimed in claim 1 comprising: a text; and the text being imprinted unto the first rear pocket.

* * * * *